7/1/86 XR 4,597,400

United States Patent [19]

Trudeau, Sr.

[11] Patent Number: 4,597,400

[45] Date of Patent: Jul. 1, 1986

[54] UMBRELLA, PARASOL AND THE LIKE

[76] Inventor: David L. Trudeau, Sr., 41 Lane Ave., Portland, Me. 04103

[21] Appl. No.: 601,028

[22] Filed: Apr. 16, 1984

Related U.S. Application Data

[63] Continuation-in-part of Ser. No. 314,548, Oct. 26, 1981.

[51] Int. Cl.[4] ..... A45B 21/00; A45B 11/00; A45B 25/18; E04H 15/02

[52] U.S. Cl. ..... 135/18; 135/20 A; 135/33 C; 135/900

[58] Field of Search ..... 135/16, 20 R, 33 C, 135/34, 17, 18, 98, 20 A, 20 M, 35 V, 35 S, 41, 900, 901; D3/5-6; 2/195, 196, 199

[56] References Cited

U.S. PATENT DOCUMENTS

| | | | |
|---|---|---|---|
| D. 12,602 | 12/1881 | Wright | D3/6 |
| 160,214 | 2/1875 | Martin | 135/20 R |
| 229,752 | 7/1880 | Ray | 135/20 A |
| 455,591 | 7/1918 | Harmer | 135/41 |
| 635,811 | 10/1899 | Rothschild | 135/34 |
| 780,836 | 1/1905 | Susemihl et al. | 135/46 |
| 1,053,337 | 2/1913 | Williams | 135/98 X |
| 1,718,417 | 6/1929 | Greenberg | 135/76 X |
| 1,819,912 | 8/1931 | McGaffey | 135/33 R X |
| 2,147,872 | 2/1939 | Wittcoff | 135/20 R X |
| 2,742,913 | 4/1956 | Weisblatt | 135/33 C |
| 2,841,160 | 7/1958 | Wispelere | 135/35 S |
| 3,951,160 | 4/1976 | Nitu | 135/35 S X |

FOREIGN PATENT DOCUMENTS

| | | | |
|---|---|---|---|
| 51-19952 | of 1976 | Japan | 135/20 R |

OTHER PUBLICATIONS

Umbrella; Base Hit? *USA Today*, Wed., 1-25-84 p. 2B.

*Primary Examiner*—Robert A. Hafer
*Assistant Examiner*—D. Neal Muir
*Attorney, Agent, or Firm*—Auslander and Thomas

[57] ABSTRACT

An umbrella having substantially the appearance of a conventional umbrella extends to open in the form of a baseball hat with the brim extending. The hat includes baseball team insignia. The closing of the umbrella infolds the brim on a linkage interconnected with the usual umbrella closing mechanism. The closed umbrella with a cover and a bat handle is a set which makes the umbrella have the appearance of a baseball bat.

4 Claims, 6 Drawing Figures

UMBRELLA, PARASOL AND THE LIKE

This is a continuation-in-part of U.S. patent application Ser. No. 314,548 filed Oct. 26, 1981.

BACKGROUND OF THE INVENTION

The present invention relates to umbrellas and/or parasols and particularly to an umbrella operable in the shape of a baseball hat, which may assume, in closed condition the shape of a baseball bat. The present invention is an umbrella or parasols particularly adapted for use at baseball games or for use by baseball fans.

A novel aspect of the present invention is that it appears as a functioning umbrella. In open condition it has an extendable brim and is in the shape of a baseball hat, has baseball team insignia, and may include a handle like a baseball bat handle. The brim extends and retracts, linked to the umbrella's operating mechanism. The physical aspects of the umbrella of the present invention associate with baseball and are associatable with any particular selected team.

The second aspect of the present invention is that the umbrella of the present invention when closed may continue it's association with baseball yet in another form. With a cover, the closed umbrella may take the shape of a baseball bat, including the umbrella handle having the shape of a bat handle.

Optionally the umbrella panel gores may be in colors associated with a selected baseball team colors.

Enablement of the present invention is in providing a substantially conventional umbrella top portion in the shape of the crown of a baseball hat and including a baseball hat brim extendable on opening of the umbrella and retractable by unfolding when closed, all controlled by a interlinkage. The linked unfolding immediately converts the open umbrella to a baseball team hat. In closed position the umbrella looks substantially like a usual umbrella yet is it adapted to be covered and have the shape of a baseball bat.

The elements of the present invention are the umbrella crown equal to the hat crown, the linked infoldable brim enabling the the umbrella to function as an ordinary umbrella. The handle in the form of a bat handle adds to the physical association of the present invention to baseball and further, with a cover enables the transformation of the umbrella into a second shape, that of a baseball bat.

The linkage for the unfolding of the brim in itself is not novel and various linkages may be used. Unfolding generally similar to the present invention may be found in a contemporary KNIRPS® folding umbrella. The linkage shown in the specification is exemplary. Foldable linkages per se can be found in U.S. Pat. No. 3,779,260.

Mere foldable extensions from the umbrella may be found in U.S. Pat. No. 2,024,105, Japanese Utility Model No. 19952/76 and U.S. Pat. No. 160,214, None of which include an umbrella in the form of a hat with an interlinked retractable brim which infolds on closing and extends on opening.

The existence of brims or visors per se as state of the art, can be noted as in U.S. Pat. No. 2,931,046. Hat and umbrella combinations per se are disclosed in U.S. Pat. Nos. 2,726,668 and 1,718,417.

U.S. Pat. No. Des. 12,602 exemplifies a type of umbrella where the handle and peak associate the umbrella with tennis. This look is achieved solely by the unitary impression created by the design elements as distinguished from a mechanical conversion of an umbrella into another shape as with the present invention. U.S. Pat. No. 1,819,912 shows a multipurpose umbrella utilizing a golf club. U.S. Pat. No. 2,380,175 discloses a doll adapted to function as an umbrella. While U.S. Pat. No. 2,380,175 discloses a combination umbrella, the patent does not show nor suggest any interlinkage for the umbrella of the '175 patent to a function or appear as a substantially usual umbrella when it is closed.

Exemplary of multipurpose umbrella handles is U.S. Pat. No. 3,038,483 where the handle of an umbrella functions as both handle and the pistol grip of an integrate water pistol.

U.S. Pat. Nos. 3,526,238 and 2,724,913 are exemplary of umbrellas which are coverable, these covers though neither show nor suggest a changed appearance of the umbrella when covered such as in the present invention where the cover combined with the bat handle handle of the umbrella converts the umbrella to the shape of a baseball bat.

SUMMARY OF THE INVENTION

Accordingly, it is an object of the present invention to provide an umbrella or parasol in which in closed position is substantially a usual umbrella and which in open position has the shape of a baseball hat including an extended brim. A further object of the present invention is to provide an umbrella in the form of a baseball hat with an extendable brim. An interlinkage with the mechanics of the umbrella extends the brim while opening the umbrella and retracts the brim against the body of the closed umbrella.

Another object of the present invention is to provide an umbrella including a shape as a baseball hat, having baseball symbols such as team insignia and having a handle in the shape of a baseball bat handle.

Another object of the present invention is to provide an umbrella adaptable to a second shape where in closed position a cover interacts with the baseball bat handle to provide an umbrella having the shape of a baseball bat.

Another object of the present invention is to provide an umbrella useable by a seated spectator at a baseball game wherein the extended brim of the opened umbrella in the shape of a baseball hat provides a canopy to effectively shade the legs and feet of a spectator from rain.

Although such novel feature or features believed to be characteristic of the invention are pointed out in the claims, the invention and the manner in which it may be carried out, may be further understood by reference to the description following and the accompanying drawings.

DETAILED DESCRIPTION OF THE INVENTION

Figure 2:
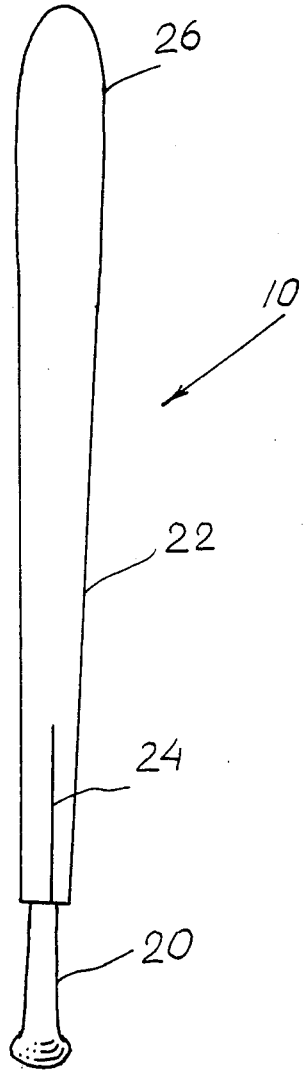
FIG. 2 is a side view of the umbrella or parasol of FIG. 1 in its folded mode with its cover in place.

As can be seen from the preceding, in its opened mode, the umbrella 10 or parasol simulates the shape of a baseball hat 10 yet is adapted when covered to assume the shape of a baseball bat as shown in FIG. 2.

It should be noted that the shape of umbrella 10 is particularly suited for protecting spectators at sporting events. That is, in the closely packed stands at a baseball game, for example, brim 14 in FIG. 1. is useful for protecting the legs of a seated spectator.

Figure 1:
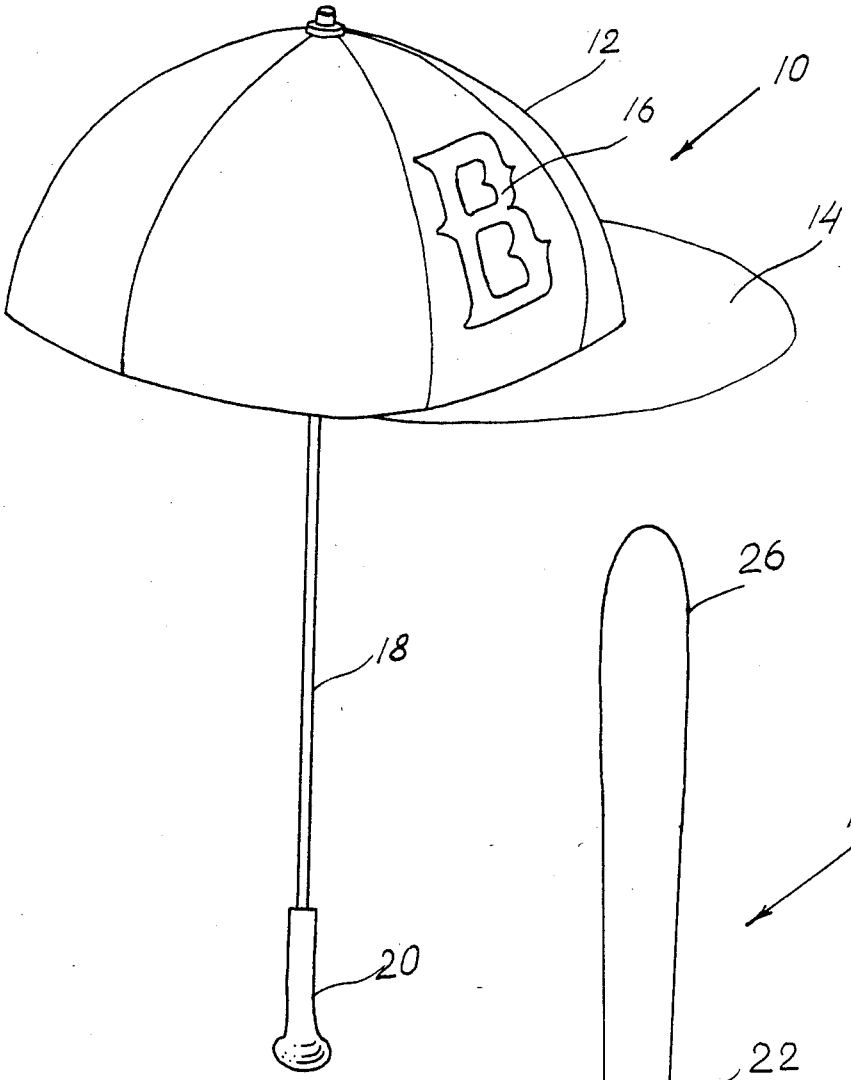
FIG. 1 is a perspective view of a typical umbrella or parasol according to an embodiment of the invention in its opened mode.

Referring now to FIG. 1, there is shown, generally at 10 a parasol or umbrella according to one embodiment of the invention. The embodiment of FIG. 1, in its opened mode shown, simulates a baseball cap having a crown 12 and a brim 14. Crown 12 may include one or more team indicia 16 appropriate to baseball.

A shaft 18 supports the crown and brim 14. The lower end of shaft 18 terminates in a handle 20 which appropriately simulates the grip end of a baseball bat. In the preferred embodiment, handle 20 may, in fact, be made of ash wood turned to produce the same appearance as a conventional baseball bat.

Referring now to FIG. 2, parasol or umbrella 10 of FIG. 1 is shown in the folded mode and covered by a cover 22 which is slipped over the folded crown 12 and brim 14 and joining or overlapping handle 20. A slit 24 may be employed to ease insertion.

A forward end 26 of cover 22 is shaped by any convenient means such as, for example, by interior padding to provide the rounded end conventional in baseball bats. Cover 22 is preferably of a plastic or fabric having a color and/or texture similar to handle 20 so that the overall affect of umbrella or parasol 10 in its folded and covered mode is that of a baseball bat.

Figures 3, 6:
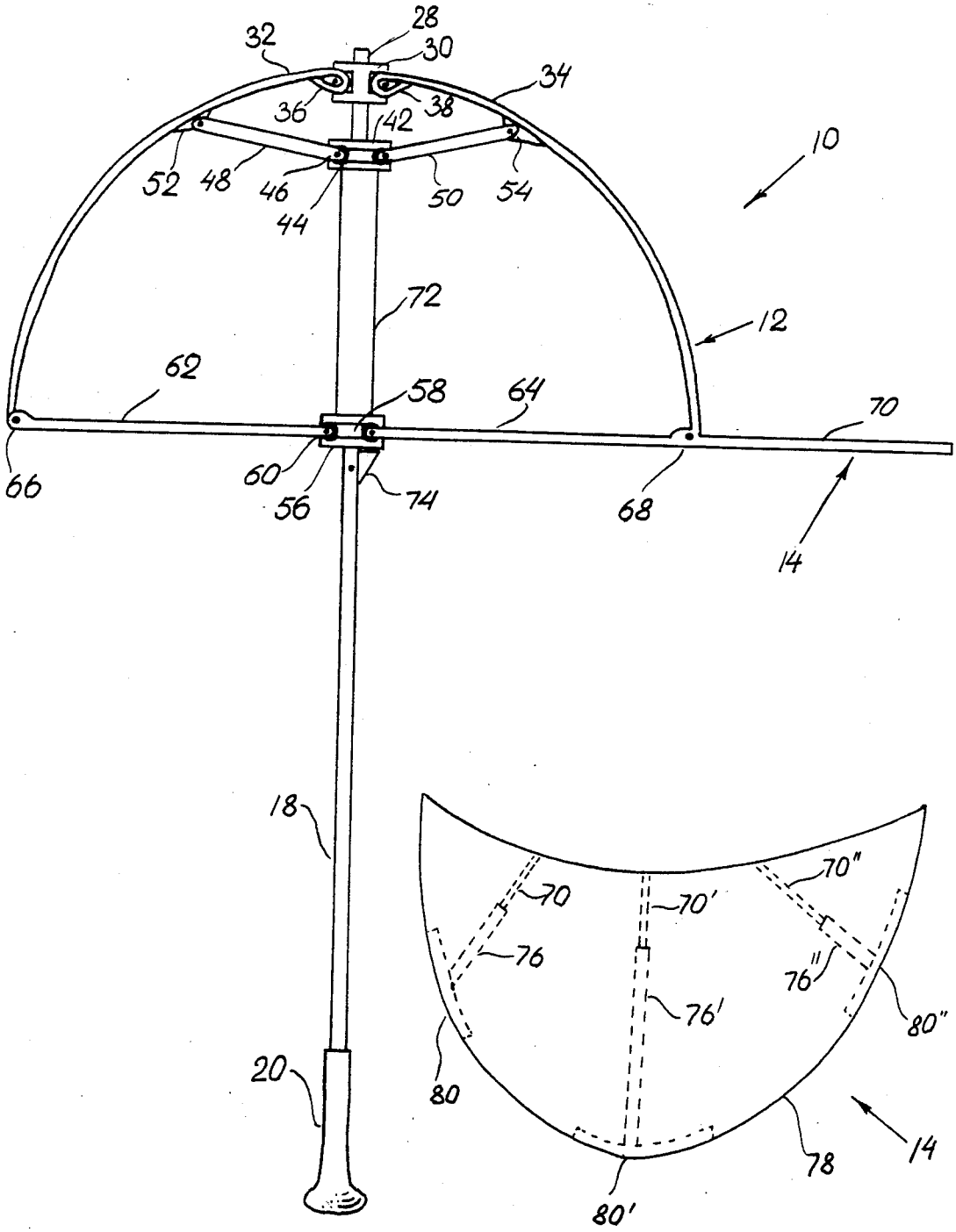
FIG. 3 is a simplified view of the umbrella or parasol of FIG. 1 showing exemplary supporting structure.
FIG. 6 is a top view of the brim of the baseball hat of FIG. 1

Referring now to FIG. 3, a cross section through the frame of the umbrella or parasol 10 is shown. It is to be understood that the frame is exemplary of one structure effectuating the purpose of the present invention. The frame as disclosed consists of a plurality of similar members angularly spaced about the shaft 18 but the additional members are omitted for clarity.

The upper end of shaft 18 terminates in a ferrule 28 having an annular groove 30 therein. Ribs 32 and 34 are hingeably secured to ferrule 28 by a loop of wire 36 passing through loops 36 and 38 in ribs 32 and 34 respectively.

Although other embodiments may employ different materials, the baseball hat embodiment of an umbrella 10 preferably employs a spring steel wire or the like in ribs 32 and 34 to permit the formation of a curve extending over an angular range of approximately 90 degrees.

A spool-type sleeve 42 having an annular groove 44 therein receives a wire loop 46 which hingeably engages and retains inner end of spreaders 48 and 50 which are, in turn, hingeably attached to intermediate points 52 and 54 on ribs 32 and 34 respectively by conventional means which are unnecessary to describe in detail.

A further spool-type sleeve 56 having an annular groove 58 therein contains a wire loop 60 effective to hingeably support inner ends of lower spreaders 62 and 64. Lower spreader 62 is hingeably attached at its end 66 by conventional means to the lower end of rib 32. This method of attachment is common to the sides and back of crown 12.

Lower spreader 64 is hingeably attached at an intermediate point 68 to the lower extremity of rib 34 by conventional means and continues in a cantilevered extension 70. A plurality of cantilevered extensions 70 may be employed to form the shape and support brim 14. With the construction shown, brim 14 is retractable against crown 12 when umbrella 10 is folded.

An intermediate spacer tube 72 is slideably arranged on shaft 18 to establish a minimum spacing between spool-type sleeves 42 and 56 as will be explained. Intermediate spacer tube 72 may be integral with one of spool-type sleeves 42 and 56 or, alternately, may be a separate element.

A conventional spring latch 74 is employed to hold spool-type sleeve 56 in the position shown to maintain the umbrella in the opened position or, alternately, may be hinged into shaft 18 to permit spool-type sleeve 56 and intermediate spacer tube 72 to slide over it and thus permit umbrella 10 to be folded.

In some applications, it may be inconvenient to have lower spreaders 62 and 64 at the lower extremity of crown 12 as shown since this may prevent the user's head from entering the canopy. Various kinds of hinged or strap-braced arrangements may be used to place the equivalents of lower spreaders 62 and 64 further up into crown 12. Alternatively, lower spreaders 62 and 64 may be eliminated with spreaders 48 and 50 being relied upon, in combination with the fabric (not shown) covering crown 12 to establish the shape of crown 12. In this event, cantilevered extensions 70 may be hingeably operated by, for example, a bar (not shown) extending down from spreader 50.

Figure 4:
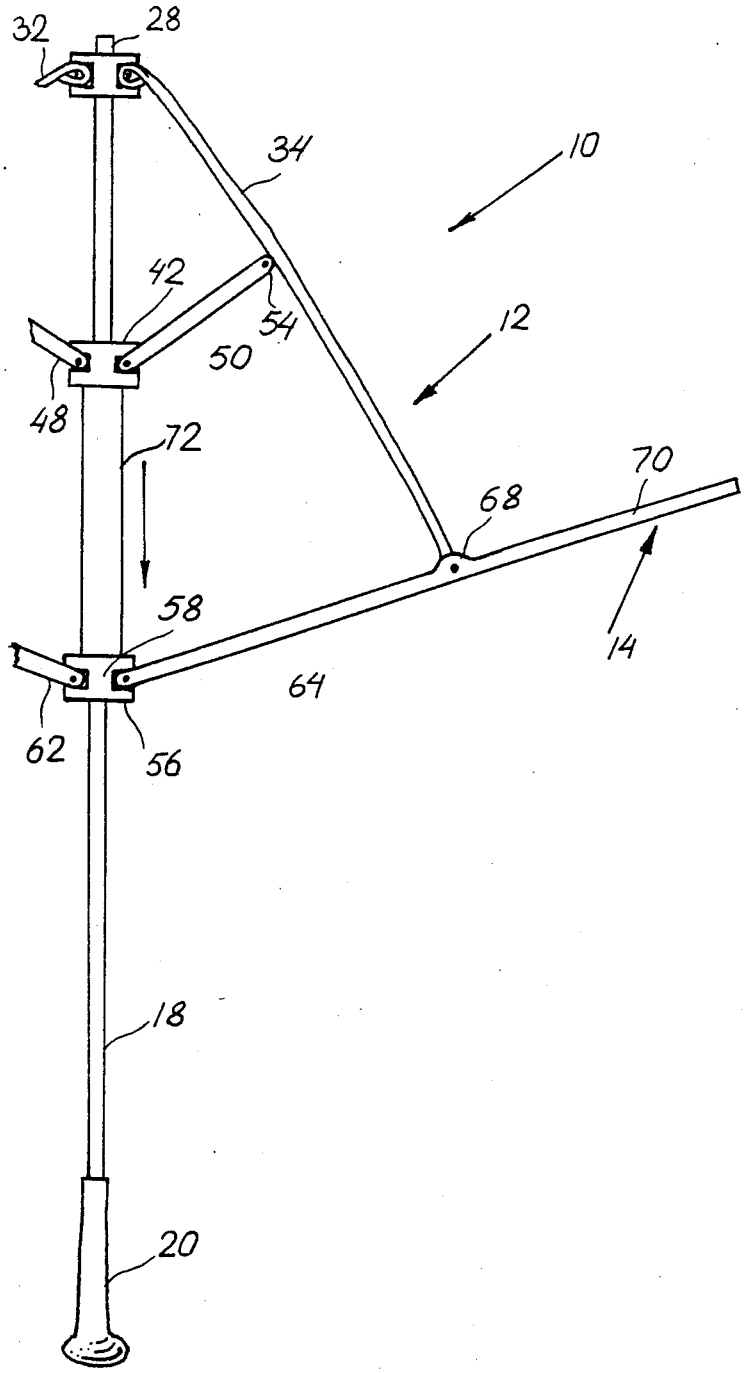
FIG. 4 is a view corresponding to FIG. 3 partly folded.

Referring now to FIG. 4, umbrella 10 is shown partly folded wherein spool-type sleeves 42 and 56 and intermediate spacer tube 72 are moved as a unit down shaft 18. This tends to straighten out ribs 32 and 34 as spreaders 48 and 50 are hinged toward shaft 18. In addition, spreaders 62 and 64 are similarly hinged, except at a smaller angle due to their larger radius.

Figure 5:
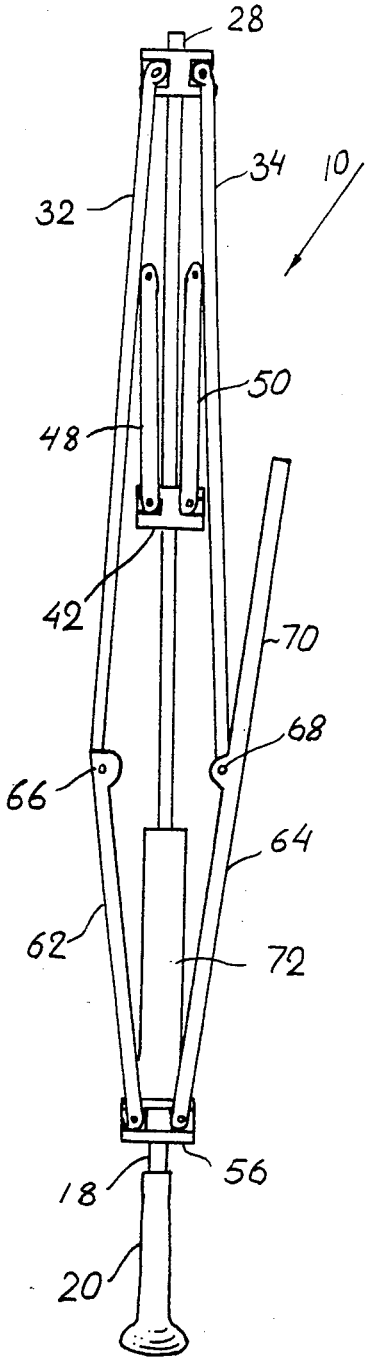
FIG. 5 is a view corresponding to FIG. 3 fully folded.

Referring now to FIG. 5, wherein umbrella 10 is substantially fully folded, spreaders 48 and 50 are rotated to generally parallel vertical positions and ribs 32 and 34 assume approximately straight positions alongside spool-type sleeve 42. Intermediate spacer tube 72 and spool-type sleeve 56 have moved away from spool-type sleeve 42 down shaft 18 and have thereby rotated lower spreaders 62 and 64 into generally parallel verti cal positions. This motion of lower spreader 62 rotates cantilevered extension 70 upward against rib 34 in the fully folded position.

In the folded position in FIG. 5, it would be clear that umbrella 10 can be slipped into cover 22 (FIG. 2) with the final outside shape of cover 22 being formed both by the shape of umbrella 10 as well as by padding or shapers in the end of cover 22.

Referring now to FIG. 6, a top view of brim 14 is shown including a plurality of slide tubes 76, 76' and 76'' into which are fitted ends of cantilevered extensions 70, 70' and 70''. Slide tubes 76, 76' and 76'' permit fabric 78 of which brim 14 is made to readjust itself on cantilevered extensions 70, 70' and 70'' as umbrella 10 is opened and closed.

A shaper element 80, 80' and 80'' may be employed at the outer ends of slide tube 76, 76' and 76'' respectively to help form the contour of the perimeter of brim 14. Slide tubes 76, 76' and 76'' may be replaceable by sewn tubes (not shown) in fabric 78 or, alternatively, by loops (not shown) of thread or other material.

It is further within the contemplation of the present invention that shaper elements 80, 80' and 80" may be rigidly or hingeably affixed directly to the ends of cantilevered extension 70 without the sliding feature provided by slide tubes 76, 76' and 76".

The terms and expressions which are employed herein are used as terms of description only and it is recognized that various modifications are possible within the scope of the invention claimed.

It is understood the following claims are intended to cover all of the generic and specific features of the invention herein described, and all statements of the scope of the invention which, as a matter of language, might fall there between.

Having described certain forms of the invention in some detail, what is claimed is:

1. An umbrella said umbrella including a shaft having a longitudinal axis, a plurality of ribs pivotably mounted on said shaft, a plurality of spreaders interlinked with said ribs and adapted to interact with said shaft to extend and retract said ribs to open and close said umbrella, a webbing, said webbing adapted to be mounted on said ribs adapted to form a canopy when said ribs are extended and said umbrella is open, a plurality of extensions, said plurality of extensions, mounted along only a portion of the periphery of said canopy, said webbing supported on said extensions, said webbing integral to said canopy, and interlinkage means movably attached at one end to said shaft, the opposite end of said interlinkage means attached to said extensions and adapted to extend said extensions with said webbing substantially perpendicular from said axis when said umbrella is open and to retract said extension and webbing closely against the webbing of said canopy when said umbrella is closed, whereby said umbrella has the appearance of a large hat when open.

2. An umbrella according to claim 1 wherein said handle is in the shape of a baseball bat handle.

3. An umbrella according to claim 1, wherein said brim portion shape is adapted to shield the legs and feet of a seated user.

4. An umbrella set according to claim 2, including a cover, said cover adapted to cover said umbrella when in closed condition, said umbrella in said cover simulating the shape of a baseball bat.

* * * * *